US007703574B2

(12) United States Patent
Krüger et al.

(10) Patent No.: US 7,703,574 B2
(45) Date of Patent: Apr. 27, 2010

(54) EXHAUST SYSTEM

(75) Inventors: Jan Krüger, Neuhausen (DE); Marco Jess, Esslingen (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 52 days.

(21) Appl. No.: 12/132,801

(22) Filed: Jun. 4, 2008

(65) Prior Publication Data

US 2008/0302597 A1 Dec. 11, 2008

(30) Foreign Application Priority Data

Jun. 6, 2007 (DE) ..... 10 2007 026 812

(51) Int. Cl.
*F01N 1/06* (2006.01)
*F02B 27/02* (2006.01)
*F01N 1/00* (2006.01)
*F01N 1/02* (2006.01)

(52) U.S. Cl. ..... 181/254; 181/253; 60/313; 60/324

(58) Field of Classification Search ..... 181/254, 181/253, 237, 241; 123/184.53, 184.59; 60/313, 322, 323, 324
See application file for complete search history.

(56) References Cited

U.S. PATENT DOCUMENTS 2,180,843 A * 11/1939 Zand ..... 60/313
3,653,212 A * 4/1972 Gast et al. ..... 60/293
3,943,710 A * 3/1976 Lange ..... 60/288
4,527,392 A * 7/1985 Sato et al. ..... 60/313
4,685,291 A * 8/1987 Ha ..... 60/286
4,926,634 A * 5/1990 Putz et al. ..... 60/274
4,926,635 A * 5/1990 Sakuma ..... 60/299
5,014,817 A * 5/1991 Takato et al. ..... 181/254
5,097,664 A * 3/1992 Nagatomo et al. ..... 60/273
5,113,652 A * 5/1992 Baines et al. ..... 60/288
5,134,850 A * 8/1992 Saito et al. ..... 60/313
5,144,799 A * 9/1992 Barth ..... 60/313
5,317,112 A * 5/1994 Lee ..... 181/250
5,937,640 A * 8/1999 Krzykowski et al. ..... 60/284
6,141,958 A * 11/2000 Voss ..... 60/272

(Continued)

FOREIGN PATENT DOCUMENTS

DE 20206155 * 8/2002

(Continued)

*Primary Examiner*—Edgardo San Martin
(74) *Attorney, Agent, or Firm*—McGlew and Tuttle, P.C.

(57) ABSTRACT

An exhaust system (1) is provided for an internal combustion engine (4), especially in a motor vehicle, with two separate exhaust gas lines (2, 3) with a first sound transmission feature (7), which couples the two exhaust gas lines (2, 3) with one another, and with a control (9) for activating and deactivating the first sound transmission connection (7) as a function of at least one operating parameter of the internal combustion engine (4). To improve the muffling behavior, a second sound transmission connection (8) is provided, which couples the two exhaust gas lines (2, 3) with one another downstream of the first sound transmission connection (7), and makes possible, depending on the particular operating parameter, three switching states (SZ), namely, a first switching state, in which both sound transmission connections (7, 8) are deactivated, a second switching state, in which only one sound transmission connection (7, 8) is activated, and a third switching state, in which both sound transmission connections (7, 8) are activated.

20 Claims, 1 Drawing Sheet

U.S. PATENT DOCUMENTS

| | | | | |
|---|---|---|---|---|
| 6,209,318 | B1 * | 4/2001 | Rutschmann | 60/313 |
| 6,557,341 | B2 * | 5/2003 | Bubeck et al. | 60/284 |
| 6,938,729 | B2 * | 9/2005 | Worner et al. | 181/254 |
| 7,090,048 | B2 * | 8/2006 | Albertson et al. | 181/240 |

FOREIGN PATENT DOCUMENTS

| | | | | |
|---|---|---|---|---|
| EP | 1 400 666 | A1 | | 3/2004 |
| GB | 2161215 | A | * | 1/1986 |
| JP | 60247006 | A | * | 12/1985 |
| JP | 61212622 | A | * | 9/1986 |

* cited by examiner

EXHAUST SYSTEM

CROSS REFERENCE TO RELATED APPLICATIONS

This application claims the benefit of priority under 35 U.S.C. §119 of German Patent Application DE 10 2007 026 812.4 filed Jun. 6, 2008, the entire contents of which are incorporated herein by reference.

FIELD OF THE INVENTION

The present invention pertains to an exhaust system for an internal combustion engine, especially in a motor vehicle, with two separate exhaust gas lines for removing exhaust gases of the internal combustion engine.

BACKGROUND OF THE INVENTION

In passenger cars with high-performance internal combustion engines, which are preferably designed as V-engines, the exhaust gases are frequently sent from the two cylinder banks via two manifolds in two exhaust gas lines to a common end muffler or to two separate end mufflers. The two exhaust gas lines extend here in the vehicle on the underbody in a tunnel, which has heat protective shields at regularly spaced locations upwardly and to the side. The ground clearance represents an imaginary limit of the tunnel in the downward direction. Furthermore, a middle muffler, which must be arranged in the middle area of the system, can frequently be found for acoustic reasons. A separate middle muffler can be assigned here to each exhaust gas line. A common middle muffler can likewise be assigned to both exhaust gas lines. At any rate, the particular middle muffler must likewise be accommodated in the tunnel, which regularly leads to problems in terms of the space available for installation, because the particular middle muffler must have a certain minimum volume in order to be able to assume its acoustic function.

An exhaust system, which has two separate exhaust gas lines for removing exhaust gases of an internal combustion engine, is known from EP 1 400 666 A1. The prior-art exhaust system comprises, furthermore, a switchable sound transmission means, which couples the two exhaust gas lines with one another for transmitting airborne sound. The sound transmission means can be activated and deactivated by means of a control means, and this takes place as a function of at least one operating parameter of the internal combustion engine. For example, the rpm (revolutions per minute) and/or the load of the internal combustion engine are suitable operating parameters here.

The prior-art exhaust system is advantageously operated such that the sound transmission means is active at low rpms. Mufflers that are assigned to the exhaust gas lines are designed acoustically for interfering frequencies, which appear at low rpms. The sound transmission means is deactivated at higher rpms, as a result of which the effective interfering frequencies are reduced by half based on the specific assignment of the separate exhaust gas lines to individual cylinders of the internal combustion engine. Effective muffling can thus be achieved for two rpm ranges, which are related to one another via the interfering frequencies. The drawback is the limitation of the muffling action to only two rpm ranges. Furthermore, the activation of the sound transmission means at low rpms may lead to a reduction of the available engine torque because of disadvantageous effects on the charge cycle operation in the cylinders of the internal combustion engine.

SUMMARY OF THE INVENTION

This is where the present invention comes in. The present invention has the object of providing, for an exhaust system of the type mentioned in the introduction, an improved embodiment, which is characterized especially in that, for example, more torque is available at low rpms of the internal combustion engine and/or that an increased variability can be achieved for the adaptation of the muffling action and/or that the necessary space needed for installation is reduced.

This object is accomplished according to the present invention by the subject of the independent claim. Advantageous embodiments are the subject of the dependent claims.

The present invention is based on the general idea that the two exhaust gas lines can be acoustically coupled with two switchable sound transmission means, which are arranged at spaced locations from one another in the direction of flow of the exhaust gas. Increased variability can be achieved hereby for the switching states that can be set. At least three different switching states, namely, a first switching state, in which both sound transmission means are deactivated, a second switching state, in which one sound transmission means is activated while the other sound transmission means is deactivated, and a third switching state, in which both sound transmission means are activated, are of increased interest. It was found that the different switching states have significant effects on the torque of the internal combustion engine equipped with the exhaust system. In particular, the torque can increase markedly in the first switching state when this switching state is assigned to low rpms of the internal combustion engine, i.e., in operating states in which a high torque is especially desirable. Furthermore, it was found that the muffling action of the exhaust system can also be better adapted to different operating states of the internal combustion engine due to the three different switching states. However, it is particularly advantageous that, depending on the design of the switching states, the muffling action of the exhaust system as a whole can be improved to such an extent that a middle muffler may be eliminated in certain applications. The problems associated with the installation of a middle muffler in terms of the space needed for installation can be avoided as a result.

An embodiment in which the first sound transmission means located upstream is deactivated in the second operating state while the second sound transmission means located downstream is activated has proved to be particularly advantageous. The torque can be increased, for example, for medium rpms, in the second switching state.

A control means expediently assigns the switching states to different rpm ranges. The first switching state is assigned to a lower rpm range, while the second switching state is assigned to a medium rpm range and the third switching state is assigned to an upper rpm range.

It is apparent that the above-mentioned features, which are yet to be explained below, are applicable not only in the particular combination shown, but in other combinations or alone as well, without going beyond the scope of the present invention. Preferred exemplary embodiments of the present invention are shown in the drawings and will be explained in more detail in the following description, identical reference numbers designating identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
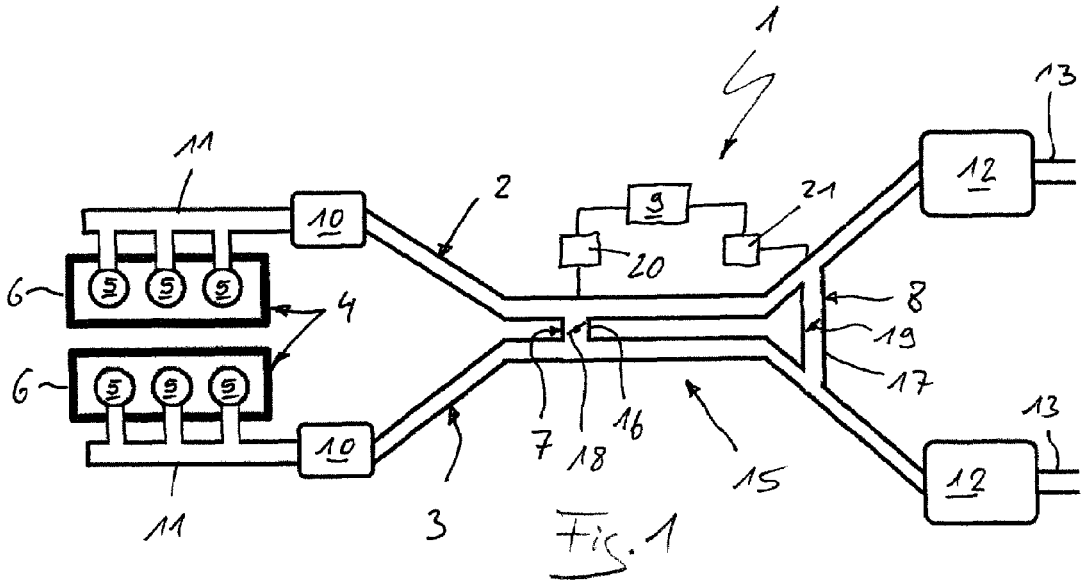
FIG. 1 is a greatly simplified circuit diagram-like general view of an exhaust system according to the invention.
Figure 2:
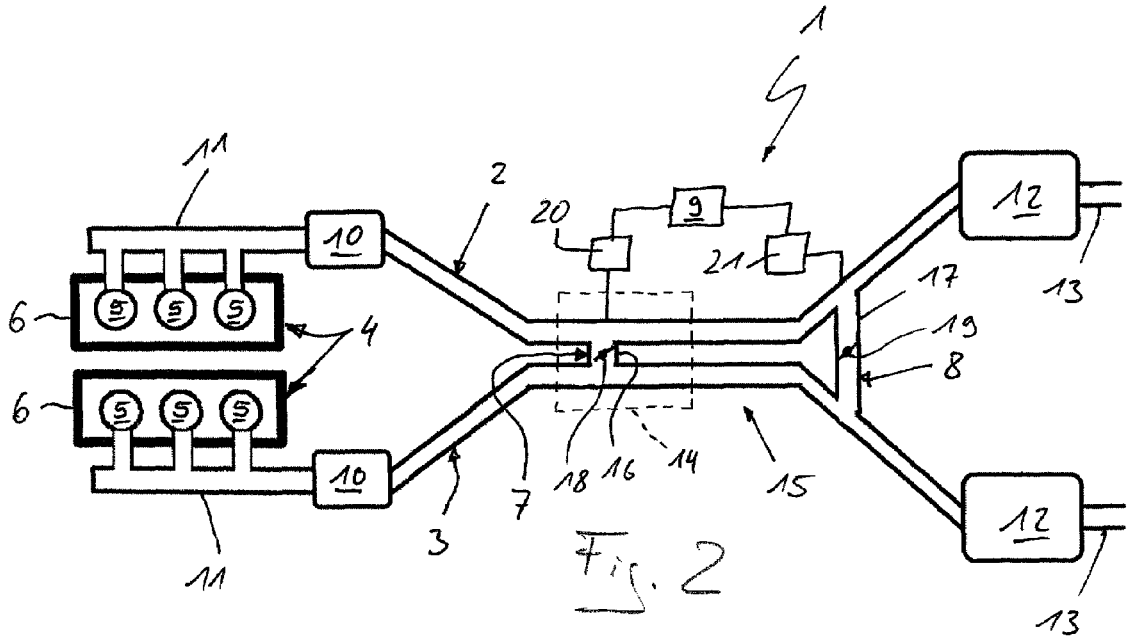
FIG. 2 is a view as in FIG. 1, but showing a greatly simplified circuit diagram-like general view of an exhaust system according to another embodiment of the invention.

Referring to the drawings in particular, corresponding to FIGS. 1 and 2, an exhaust system 1 comprises two separate exhaust gas lines 2 and 3. The exhaust system 1 is used to remove the exhaust gases in an internal combustion engine 4, which may be arranged especially in a motor vehicle. The two exhaust gas lines 2, 3 are assigned here to different cylinders 5 of the internal combustion engine 4. Without limitation of the general scope, a six-cylinder engine is shown in the example. The two exhaust gas lines 2, 3 are generally assigned to a group of cylinders 5 each in a preferred design, the groups being selected such that the cylinders 5 of one group of cylinders and the cylinders 5 of the other group of cylinders have their working strokes alternatingly.

The group of cylinders may likewise be selected such that cylinders operating in parallel are always arranged in different groups of cylinders. This applies especially to larger engines, such as V-8 or V-12 engines.

The exhaust system 1 has, in addition, a first switchable sound transmission means 7, which is designed such that it can couple (communicate) with the two exhaust gas lines 2, 3 for the transmission of airborne sound. In addition, the exhaust system 1 according to the present invention comprises a second switchable sound transmission means 8, which is designed such that it can couple (communicate) with the two exhaust gas lines 2, 3 downstream of the first sound transmission means 7 for the transmission of airborne sound.

A control means 9 is provided for switching or actuating the two sound transmission means 7. This control means 9 is designed such that it can actuate the two sound transmission means 7, 8 as a function of at least one operating parameter of the internal combustion engine 4 for activation and deactivation. Sound transmission takes place between the two exhaust gas lines 2, 3 through the particular sound transmission means 7, 8 in the particular activated state. However, the sound transmission between the two exhaust gas lines 2, 3 through the particular sound transmission means 7, 8 is absent in the deactivated state. The control means 9 is designed according to the present invention, in addition, such that it can actuate the two sound transmission means 7, 8 as a function of the at least one operating parameter of the internal combustion engine 4 to create at least three different switching states. Both sound transmission means 7, 8 are deactivated in a first switching state. One of the sound transmission means 7, 8 is activated, while the respective other sound transmission means 7, 8 is at the same time deactivated in the second switching state. Both sound transmission means 7, 8 are then activated in a third switching state. To create the second switching state, the control means 9 preferably controls the sound transmission means 7, 8 such that the first sound transmission means 7 located upstream is deactivated and that the second sound transmission means 8 located downstream is activated. The control means 9 preferably uses an rpm of the internal combustion engine 4 as an operating parameter to actuate the sound transmission means 7, 8 as a function of the rpm.

Especially advantageous is here an embodiment, in which the control means 9 is designed such that it divides the rpm range of the internal combustion engine 4 as a whole into three rpm ranges. In a lower rpm range, the control means 9 actuates the sound transmission means 7, 8 for setting the first switching state. In a medium rpm range, the control means 9 sets the second switching state on the sound transmission means 7, 8. In an upper rpm range, the control means 9 then creates the third switching state. The corresponding rpm information is received by the control means 9, e.g., from an engine control device, which is not being shown here. In particular, the control means 9 may be integrated in terms of hardware in such an engine control device or implemented in terms of software.

For example, the lower rpm range may comprise rpms up to 1,500 rpm for a six-cylinder engine, whereas the middle rpm range may comprise rpms from about 1,500 rpm to about 2,500 rpm. The upper rpm range can have rpms beginning from 2,500 rpm and upwards.

Corresponding to FIGS. 1 and 2, a catalytic converter 10 may be arranged in each exhaust gas line 2, 3. It is usually an oxidation type catalytic converter, with which unburned hydrocarbons and carbon monoxide are reacted. Such a catalytic converter 10 is usually located relatively close to the internal combustion engine 4, especially directly following an exhaust gas collector or manifold 11. Furthermore, each exhaust gas line 2 in the embodiments being shown here contains a muffler 12. These mufflers 12 may be especially so-called end mufflers, whose outlet leads to the tail pipe 13 of the respective exhaust gas line 2, 3. Instead of two separate mufflers 12 assigned to one of the exhaust gas lines 2, 3 each, it is also possible, in principle, to provide a common muffler, which is then assigned to both exhaust gas lines 2, 3.

Corresponding to FIG. 2, it is possible, in principle, to equip the exhaust system 1 with at least one middle muffler 14, which may be assigned especially to both exhaust gas lines 2, 3 together. Depending on the application and depending on the design of the exhaust system 1, it is possible due to the use of the two sound transmission means 7, 8 according to FIG. 1 to do away with such a middle muffler 14 and yet to guarantee sufficient muffling.

Corresponding to FIGS. 1 and 2, the first sound transmission means 7 is arranged on the two exhaust gas lines 2, 3 downstream of the catalytic converters 10. Furthermore, the first sound transmission means 7 is located upstream of muffler 12. The second sound transmission means 8 is arranged on the two exhaust gas lines 2, 3 upstream of the two mufflers 12. In addition, the second sound transmission means 8 is located downstream of the first sound transmission means 7 and hence downstream of the catalytic converters 10.

In the embodiment shown, which is preferred in FIG. 1, the particular exhaust gas line 2, 3 has no additional muffler upstream of the second sound transmission means 8. Even though other exhaust gas treatment means may definitely be arranged upstream of the second sound transmission means 8 in the particular exhaust gas line 2, 3, especially also downstream of the first sound transmission means 7, such as, e.g., a particle filter or an SCR catalytic converter or a Denox catalytic converter, a component designed exclusively as a muffler is no longer present. The pressure loss in the particular exhaust gas line 2, 3 can be reduced as a result.

According to FIGS. 1 and 2, the two exhaust gas lines 2, 3 may extend in parallel to one another in a middle area 15. This middle area extends in the installed state in a tunnel, which is located on the underbody of the particular vehicle. The first sound transmission means 7 is arranged in the examples being shown on the particular exhaust gas line 2, 3 in this middle area 15, which extends in the tunnel. In addition or as an alternative, it is also possible to select a positioning for the second sound transmission means 8, in which positioning the second sound transmission means 8 is located in the middle area 15 extending in the tunnel.

The first sound transmission means 7 is preferably arranged in the particular exhaust gas line 2, 3 in an area that is smaller than or equal to 50% of a flow path leading from the internal combustion engine 4 to the particular muffler 12. The first sound transmission means 7 may be preferably positioned at about 30% to 50% or at about 40% to about 50% or at about 50% of this flow path. Contrary to this, it applies to the positioning of the second sound transmission means 8 that this is located in a range greater than 50% of the flow path. The second sound transmission means 8 is preferably located in a range from about 50% to 100% or from about 70% to 100% or from about 80% to 100% of the flow path. It was found that an embodiment is especially advantageous if a flow path between the sound transmission means 7, 8 within the particular exhaust gas line is at least 50 cm.

The particular sound transmission means 7 may have a connection pipe 16 or 17, which connects the two exhaust gas lines 2, 3 to one another such that they communicate. Furthermore, the particular sound transmission means 7 may have an actuator 18 or 19, e.g., a slide or a valve or a diaphragm, which is designed such that the particular connection pipe 16, 17 can be opened and closed with it. Furthermore, actuating drives 20 and 21 are also indicated, which are used to drive the particular actuator 18, 19 and which can be actuated or energized by means of the control means 9. The particular sound transmission means 7, 8 is designed in the simplest case such that only two switching states can be set on it, namely, an active state with maximum sound transmission or maximally opened cross section in the respective connection pipe 16, 17, and an inactive state with no or minimal sound transmission or with closed or minimally opened cross section in the respective connection pipe 16, 17. However, embodiments in which at least one of the sound transmission means 7, 8 can embody at least one intermediate state, in which the sound transmission between the exhaust gas lines 2, 3 is activated only partly or deactivated only partly, so that especially the flow cross section in the particular connection pipe 16, 17 is opened only partly or is closed only partly, are conceivable, in principle, as well.

The exhaust system 1 according to the present invention operates as follows:

Both sound transmission means 7, 8 are deactivated during operation of the internal combustion engine 4 in the lower rpm range, i.e., for example, below 1,500 rpm. The exhaust gases of the two banks of cylinders 6 are then removed separately, without there being any acoustic coupling between the two exhaust gas lines 2, 3. Interactions between the acoustic coupling and charge cycle operations can also be avoided as a result. Such interactions may occur in the case of an acoustic coupling especially at low rpms, because sound waves are also pressure pulsations, which can also propagate upstream and may affect charge cycle operations adversely as a result. The second sound transmission means 8 is activated in the middle rpm range, i.e., above 1,500 rpm and below 2,500 rpm. As a result, additional torque can be obtained for the middle rpm range. The first sound transmission means 7 is also activated in the upper rpm range, i.e., above 2,500 rpm, as a result of which additional torque is made available. Effective muffling can be achieved for the particular rpm range by a corresponding coordination of the common end muffler or of the two separate end mufflers 12 as well as optionally of the middle muffler 14.

While specific embodiments of the invention have been shown and described in detail to illustrate the application of the principles of the invention, it will be understood that the invention may be embodied otherwise without departing from such principles.

What is claimed is:

1. An exhaust system for a motor vehicle internal combustion engine, exhaust system comprising:

two separate exhaust gas lines for removing exhaust gases of a internal combustion engine;

a switchable first sound transmission means, which couples said two exhaust gas lines with one another for the transmission of airborne sound;

a switchable second sound transmission means downstream of said first sound transmission means, said second sound transmission means couples said two exhaust gas lines with one another for the transmission of airborne sound, a control means for activating and deactivating said first sound transmission means and for activating and deactivating said second sound transmission means as a function of at least one operating parameter of said internal combustion engine to provide at least three switching states for said two sound transmission means, said at least one operating parameter being a revolutions per minute operating parameter of the internal combustion engine, said at least three switching states comprising:

a first switching state, in which said two sound transmission means are deactivated, wherein said first sound transmission means and said second sound transmission means are in a closed state in said first switching state, whereby one of said separate exhaust gas lines is not in communication with another one of said separate exhaust gas lines, said control means setting said first switching state in a first rpm range;

a second switching state, in which one of said first sound transmission means and said second sound transmission means is activated, while another one of said first sound transmission means and said second sound transmission means is deactivated, said control means setting said second switching state in a second rpm range, said another one of said first sound transmission means and said second sound means being in said closed state in said second switching state, said one of said first sound transmission means and said second transmission means being in an at least partially open state in said second switching state such that said one of said separate exhaust gas line is in communication with said another one of said separate exhaust gas line; and a third switching state, in which both of said first sound transmission means and said second sound transmission means are activated, said control means setting said third switching state in a third rpm range, said first sound transmission means and said second sound transmission means being in said at least partially open state in said third switching state, said first rpm range being less than second rpm range, said second rpm range being less than said third rpm range.

2. An exhaust system in accordance with claim 1, wherein said first sound transmission means is located upstream of said second sound transmission means and is deactivated in said second switching state, while said second sound transmission means, located downstream of said first transmission means, is activated.

3. An exhaust system in accordance with claim 1, wherein said first rpm range is less than 1,500 rpm, said second rpm range being greater than 1,500 rpm and less than 2,500 rpm, said third rpm range being greater than 2,500 rpm.

4. An exhaust system in accordance with claim 1, wherein said two exhaust gas lines are each respectively assigned to one group of cylinders of said internal combustion engine including cylinders of one group of cylinders and cylinders of another group of cylinders performing working strokes alternatingly or synchronously, and said two exhaust gas lines are assigned to a bank of cylinders each of the internal combustion engine designed as a V-engine.

5. An exhaust system in accordance with claim 1, wherein:

said first sound transmission means is arranged connected to both said exhaust gas lines downstream of a respective catalytic converter of said exhaust gas lines;

said second sound transmission means is arranged connected to both of said exhaust gas lines upstream of a muffler means, said muffler means comprising one of a separate mufflers for each of said exhaust gas lines and a common muffler for said exhaust gas lines.

6. An exhaust system in accordance with claim 1, wherein said exhaust gas lines contain no muffler upstream of said second sound transmission means.

7. An exhaust system in accordance with claim 1, wherein said first sound transmission means in said particular exhaust gas line is arranged in a range smaller than or approximately equaling 50% or about 30% to 50% or about 40% to 50% of a flow path between said internal combustion engine and a muffler assigned to said respective exhaust gas line.

8. An exhaust system in accordance with claim 1, wherein said second sound transmission means is arranged in said particular exhaust gas line in a range greater than or equaling 50% or about 50% to 100% or about 70% to 100% or about 80% to 100% of a flow path between said internal combustion engine and a muffler assigned to said particular exhaust gas line.

9. An exhaust system in accordance with claim 1, wherein one or more of said first sound transmission means and said second sound transmission means is arranged on said two exhaust gas lines in a range in which said two exhaust gas lines extend in a tunnel of the vehicle in the mounted state.

10. An exhaust system in accordance with claim 1, wherein a flow path between said two sound transmission means in said exhaust gas line is at least 50 cm.

11. An exhaust system internal combustion engine claim 1, wherein each respective said sound transmission means has a connection pipe, which connects said two exhaust gas lines in such a way that said two exhaust gas lines communicate with one another, and said respective sound transmission means has an actuator for opening and closing said particular connection pipe.

12. An internal combustion engine exhaust system comprising:

a first exhaust gas line connected to a particular set of pistons of the internal combustion engine for removing some of the exhaust gases of an internal combustion engine;

a second exhaust gas line connected to another particular set of pistons of the internal combustion engine for removing some of the exhaust gases of a internal combustion engine;

a first sound transmission means, connected between said first exhaust gas line and said second exhaust gas line, for the transmission of airborne sound, said first sound transmission means including a first actuator and a first actuator drive for switching a state of airborne sound transmission between said first exhaust gas line and said second exhaust gas line, said first actuator drive switching said first actuator between a closed state and an at least partially open state;

a second sound transmission means, connected between said first exhaust gas line and said second exhaust gas line, for the transmission of airborne sound, said second sound transmission means including a second actuator and a second actuator drive for switching a state of airborne sound transmission between said first exhaust gas line and said second exhaust gas line, said second actuator drive switching said second actuator between said closed state and said at least partially open state, said second sound transmission means being downstream of said first sound transmission means;

a control means for activating and deactivating said first sound transmission means and for activating and deactivating said second sound transmission means as a function of a revolutions per minute operating parameter of said internal combustion engine to provide at least three combination switching states for said first sound transmission means combined with said second sound transmission means, said at least three switching states comprising:

a first switching state, in which said two sound transmission means are deactivated, said control means setting said first switching state in a first revolutions per minute range of the internal combustion engine, said first actuator and said second actuator being in said closed state in said first switching state, whereby said two transmission means are in said closed state in said first switching state;

a second switching state, in which one of said first sound transmission means and said second sound transmission means is activated, while another one of said first sound transmission means and said second sound transmission means is deactivated, said control means setting said second switching state in a second revolutions per minute range of the internal combustion engine, one of said first actuator and said second actuator being in said at least partially open state in said second switching state, wherein said one of said first sound transmission means and said second sound transmission means is in said at least partially open state in said second switching state, another one of said first actuator and said second actuator being in said closed state in said second switching state, wherein said another one of said first sound transmission means and said second sound transmission means is in said closed state in said second switching state; and a third switching state, in which both of said first sound transmission means and said second sound transmission means are activated, said control means setting said third switching state in a third revolutions per minute range of the internal combustion engine, said first actuator and said second actuator being in said at least partially open state in said third switching state, wherein said first sound transmission means and said second sound transmission means are in said at least partially open state in said third switching state, said third revolutions per minute range being greater than said first revolutions per minute range and said second revolutions per minute range, said second revolutions per minute range being greater than said first revolutions per minute range.

13. An exhaust system in accordance with claim 12, wherein said first sound transmission means is located upstream of said second sound transmission means and is deactivated in said second switching state, while said second sound transmission means, located downstream of said first transmission means, is activated.

14. An exhaust system in accordance with claim 12, wherein said first revolutions per minute range is less than 1,500 rpm, said second revolutions per minute range being greater than 1,500 rpm and less than 2,500 rpm, said third revolutions per minute range being greater than 2,500 rpm.

15. An exhaust system in accordance with claim 12, wherein:

said first sound transmission means is arranged connected to both said exhaust gas lines downstream of a respective catalytic converter of said exhaust gas lines;

said second sound transmission means is arranged connected to both of said exhaust gas lines upstream of a muffler means, said muffler means comprising one of a separate mufflers for each of said exhaust gas lines and a common muffler for said exhaust gas lines.

16. An exhaust system in accordance with claim 12, wherein said exhaust gas lines contain no muffler upstream of said second sound transmission means.

17. An exhaust system in accordance with claim 12, wherein said first sound transmission means is arranged in a range smaller than or approximately equaling 50% of a flow path between said internal combustion engine and a muffler assigned to said respective exhaust gas line and said second sound transmission means is arranged in said particular exhaust gas line in a range greater than or equaling 50% of a flow path between said internal combustion engine and a muffler assigned to said particular exhaust gas line.

18. An exhaust system internal combustion engine in accordance with claim 12, wherein each respective said first sound transmission means and first sound transmission means has a connection pipe, which connects said two exhaust gas lines in such a way that said two exhaust gas lines communicate with one another, and each respective actuator of said first sound transmission means and second sound transmission means opens and closes said particular connection pipe.

19. An exhaust system internal combustion engine in accordance with claim 12, wherein a flow path between said first sound transmission means and said second sound transmission means is at least 50 cm.

20. An exhaust system internal combustion engine in accordance with claim 12, wherein said second sound transmission means is arranged in said second exhaust gas line in a range greater than or equal to 70% to 100% or about 80% to 100% of a flow path between said internal combustion engine and a muffler assigned to said second exhaust gas line.

* * * * *